United States Patent [19]

Sakatani et al.

[11] Patent Number: 4,627,927

[45] Date of Patent: Dec. 9, 1986

[54] ADDITIVE COMPOSITION FOR GRANULAR DETERGENT

[75] Inventors: Takenobu Sakatani, Chiba; Shigeru Suzuki, Ichikawa, both of Japan

[73] Assignee: Lion Corporation, Tokyo, Japan

[21] Appl. No.: 738,514

[22] Filed: May 28, 1985

Related U.S. Application Data

[63] Continuation of Ser. No. 509,728, Jun. 30, 1983, abandoned.

[30] Foreign Application Priority Data

Jul. 5, 1982 [JP] Japan ..... 57-116589

[51] Int. Cl.[4] ..... D06M 13/46; C11D 7/32

[52] U.S. Cl. ..... 252/8.75; 252/8.8; 252/528; 252/547

[58] Field of Search ..... 252/8.75, 8.8, 174.21, 252/528, 547

[56] References Cited

U.S. PATENT DOCUMENTS

| | | | |
|---|---|---|---|
| 3,154,489 | 10/1964 | Du Brow et al. | 252/8.75 |
| 3,351,483 | 11/1967 | Miner et al. | 252/547 |
| 3,533,942 | 10/1970 | Rhees et al. | 252/8.8 |
| 3,607,763 | 9/1971 | Salmen et al. | 252/547 |
| 3,936,537 | 2/1976 | Baskerville et al. | 427/242 |
| 4,134,838 | 1/1979 | Hooper et al. | 252/8.8 |
| 4,255,294 | 3/1981 | Rudy et al. | 252/524 |

*Primary Examiner*—Prince E. Willis
*Attorney, Agent, or Firm*—Armstrong, Nikaido, Marmelstein & Kubovcik

[57] ABSTRACT

An additive composition for a granular detergent comprising:

(a) a cationic surfactant having the general formula (I)

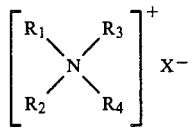

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 5 mole oxyalkylene units, and X represents a halogen atom, $CH_3SO_4$, $C_2H_5SO_4$, or

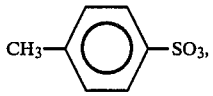

and (b) at least one nonionic surfactant selected from the group consisting of alkylethoxylates having an alkyl or alkenyl with 9 to 11 carbon atoms and having an average ethylene oxide addition mole number of 5 to 12, alkylethoxylates having an alkyl or alkenyl with 12 to 15 carbon atoms and having an average ethylene oxide addition mole number of 3 to 6, alkylphenylethoxylates having an alkyl or alkenyl with 6 to 13 carbon atoms and having an average ethylene oxide addition mole number of 3 to 8, sucrose mono- or di-fatty acid esters, and sorbitan mono- or di-fatty acid esters, the ratio of component (a)/component (b) in a weight basis of 99.5/0.5 to 50/50.

This additive composition can provide an excellent soft finish and feeling to fabrics to be washed while simultaneously washing the fabrics under any laundering conditions, without causing the deposition of the additive composition on the washed fabrics, when this additive composition is incorporated into a granular detergent.

4 Claims, No Drawings

ADDITIVE COMPOSITION FOR GRANULAR DETERGENT

This application is a continuation of application Ser. No. 509,728 filed June 30, 1983 now abandoned.

BACKGROUND OF THE INVENTION

1. Field of the Invention

The present invention relates to an additive composition suitable for use in the compounding of a granular detergent. More specifically, the present invention relates to an additive composition for a granular detergent, capable of providing an excellent soft finish or touch in fabrics to be washed, while simultaneously washing the fabrics at a low temperature, without causing deposition of the remaining additive composition particles on the washed fabrics.

2. Description of the Prior Art

Heretofore, when fabrics are washed at home, a soft finish has generally been afforded to fabrics by first washing fabrics with conventional detergents and, then, treating the fabrics with a softening agent containing as a main ingredient a cationic surfactant such as a quaternary ammonium salt after rinsing the washed fabrics with a large amount of water. However, these soft finishing operations are troublesome and time-consuming. Accordingly, it is desired by consumers to develop a detergent composition capable of simultaneously washing and softening fabrics to be washed.

It is known that only slightly water-soluble di (long chain alkyl) type quaternary ammonium salts can exhibit an excellent soft finish and antistatic effects in fabric laundering operations, as compared with water-soluble mono long-chain alkyl type quaternary ammonium salts. However, when di (long chain alkyl) type quaternary ammonium salts are used together with detergent compositions, there occur problems that the desired soft finish cannot be obtained due to the fact that the quaternary ammonium salts are not sufficiently dispersed during the laundering when the laundering temperature is low and the laundering time is short and that the di (long chain alkyl) type quaternary ammonium salts are deposited and remained in washed fabrics, which seems to be as if the soiled portions to be cleaned remain in the fabrics to be washed.

SUMMARY OF THE INVENTION

Accordingly, the main object of the present invention is to obviate the above-mentioned problems of the conventional softening technique for fabrics and to provide an additive composition for a granular detergent including a di (long-chain alkyl) type quaternary ammonium salt capable of providing an excellent soft finish in fabrics during a fabric laundering operation under any laundering conditions, without causing the deposition of the di (long-chain alkyl) type quaternary ammonium salts on the washed fabrics.

Other objects and advantages of the present invention will be apparent from the following description.

In accordance with the present invention, there is provided an additive composition for a granular detergent comprising:

(a) a cationic surfactant having the general formula (I):

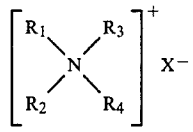

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 5 mole oxyalkylene units, and X represents a halogen atom, $CH_3SO_4$, $C_2H_5SO_4$, or

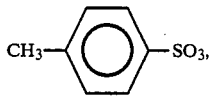

and (b) at least one nonionic surfactant selected from the group consisting of alkylethoxylates having an alkyl or alkenyl with 9 to 11 carbon atoms and having an average ethylene oxide addition mole number of 5 to 12, alkylethoxylates having an alkyl or alkenyl with 12 to 15 carbon atoms and having an average ethylene oxide addition mole number of 3 to 6, alkylphenylethoxylates having an alkyl or alkenyl with 6 to 13 carbon atoms and having an average ethylene oxide addition mole number of 3 to 8, sucrose mono- or di-fatty acid esters, and sorbitan mono- or di-fatty acid esters, the ratio of component (a)/component (b) in a weight basis of 99.5/0.5 to 50/50.

DESCRIPTION OF THE PREFERRED EMBODIMENTS

Typical examples of the quaternary ammonium salts represented by the general formula (I) as component (a) in the present invention are:

(1) distearyl dimethyl ammonium salts;

(2) dihydrogenated tallow alkyl dimethyl ammonium salts;

(3) dihydrogenated tallow alkylbenzylmethyl ammonium salts;

(4) distearyl methyl benzyl ammonium salts;

(5) distearyl methyl hydroxyethyl ammonium salts;

(6) distearyl methyl hydroxypropyl ammonium salts; and (7) distearyl dihydroxyethyl ammonium salts.

Typical counter ions of the quaternary ammonium salts are chloride and bromide. Commercially available quaternary ammonium salts generally contain lower alcohol such as ethanol and propanol, and water. However, the contents of lower alcohols and water in quaternary ammonium salts are desirably as low as possible from the standpoint of physical properties (e.g., free flowing properties and storage stability) of the resultant granular detergent. These quaternary ammonium salts can be used alone or in any mixture thereof.

Typical examples of the alkylethoxylates usable as the nonionic surfactant (i.e., component (b)) in the present invention are $C_9$–$C_{11}$ alcohol ethoxylates (an average addition mole number of ethylene oxide, i.e., $E\overline{OP}$=5–12), lauryl alcohol ethoxylates ($E\overline{OP}$=3–6), myristyl alcohol ethoxylates ($E\overline{OP}$=3–6), $C_{12}$–$C_{13}$ alcohol ethoxylates ($E\overline{OP}$=3–6), $C_{12}$–$C_{15}$ alcohol ethoxylates ($E\overline{OP}$=3–6), and $C_{14}$–$C_{15}$ alcohol ethoxylates ($EO\overline{P}$=3–6). The higher alcohol moieties of these alkylethoxylates may contain a branched chain or an unsaturated bond.

Typical examples of the alkylphenylethoxylates usable as the nonionic surfactant of component (b) in the present invention are nonylphenylethoxylates ($EO\overline{P}$=3–8), octylphenylethoxylates ($EO\overline{P}$=3–8), and dodecylphenolethoxylates ($EO\overline{P}$=3–8). The alkyl groups bonded to the benzene ring may be linear or branched groups.

Typical examples of the fatty acid esters of sucrose or sorbitan usable as the nonionic surfactant of component (b) in the present invention are mono- or di-esters of sucrose or sorbitan with lauric acid, myristic acid, palmitic acid, stearic acid, or mixed fatty acids thereof. These nonionic surfactants may be used alone or in any mixture thereof.

The weight ratio of (a) the quaternary ammonium salts to (b) the nonionic surfactants (i.e., (a)/(b)) in the present additive composition should be 99.5/0.5 to 50/50, desirably 99/1 to 75/25. The ratio (a)/(b) of more than 99.5/0.5 cannot effectively prevent the deposition of the additive composition on the washed fabrics, whereas the ratio (a)/(b) of less than 50/50 decreases the desired softening effects in fabrics.

The components (a) and (b) in the present additive composition are desirably mixed as uniform as possible and desirably granulated before their incorporation into granular detergents. For example, the granulation of the present additive composition can be carried out as follows. The quaternary ammonium salts and the nonionic surfactants are melted upon heating and, then, mixed together in the molten states. The mixture is thoroughly mixed and is granulated either by spraying followed by cooling or solidifying upon cooling followed by crushing.

The average diameter of the granules or powder particles of the present additive composition is desirably 100 to 1000 μm. Too large an average diameter of the particles of the present additive composition tends to not effectively prevent the decomposition of the additive composition particles on the washed fabrics at a low washing temperature or for a short laundering time. Contrary to this, too small an average diameter of the particles of the present additive composition tends to result in insufficient fabric softening effects under the conditions of a high laundering temperature or a long laundering time, although a deposition of the additive composition particles on the washed fabrics is improved.

The additive compositions for granular detergent according to the present invention can be compounded into any conventional granular detergents generally in an amount of 0.1% to 20% by weight, desirably 0.5% to 10% by weight, in terms of the amount of the quaternary ammonium salt, based on the amount of the granular detergent. The addition amount of the present additive composition of less than 0.1% by weight in terms of the amount of the quaternary ammonium salt results in insufficient softening effects, whereas the addition amount of more than 20% by weight decreases detergency (or detergent power) and foaming (or lathering) characteristics.

The additive composition of the present invention is generally used after being compounded into granular detergents, especially those containing as a main ingredient anionic surfactants. However, the additive composition of the present invention can be used alone without using the same in combination with granular detergents.

According to the use of the present additive composition, an excellent soft finish can be obtained in fabrics, without causing undesirable deposition of the non-dispersed quaternary ammonium salt particles on the washed fabrics, when the additive composition is used together with any conventional granular detergents.

EXAMPLE

The present invention now will be further illustrated by, but is by no means limited to, the following examples, in which all percentages are expressed on a weight basis unless otherwise specified.

EXAMPLE 1 to 11

The fabric-softening effects of various additive compositions for detergents and the deposition of the remaining additive composition particles on the washed fabrics were evaluated in the following manner.

Dihydrogenated tallow alkyl dimethyl ammonium chloride in the form of powder (Arquad 2HT, 91% purity available from Lion Akzo Co., Ltd.) was melted at a temperature of 100° C. Then, various non-ionic cellulose derivatives listed in Table 1 were separately added to the molten quaternary ammonium salt and the mixture was thoroughly mixed for about 5 minutes. Thereafter, the mixture was cooled to room temperature. The resultant blocks were crushed and ground to form powder particles having an average diameter of 250 μm. Thus, various samples of the additive compositions of the present invention were obtained.

These additive composition samples were separately incorporated into a granular detergent having the following compositions.

| Composition of granular detergent | % |
|---|---|
| Linear sodium alkylbenzene sulphonate ($C_{12}$ alkyl) | 20 |
| Sodium silicate | 10 |
| Sodium carbonate | 10 |
| Zeolite (type A, average particle diameter = 2 μm) | 20 |
| Carboxymethyl cellulose | 0.7 |
| Soap (tallow fatty acid) | 0.8 |
| Sodium sulfate and water | balance |

(1) Fabric-softening test

The fabric-softening effects of these detergent compositions were evaluated by washing sample fabrics therewith. Sample fabrics used are as follows:

| | |
|---|---|
| Nylon tricot cloth (30 denier) | 30 g × 4 pieces |
| Acrylic jersey cloth | 90 g × 2 pieces |
| Cotton towel | 80 g × 2 pieces |
| Bleached cotton cloth | 50 g × 4 pieces |
| Cotton knitted cloth | 85 g × 4 pieces |

The soiled sample fabrics were first washed in a wash liquid containing 0.13% of the above-mentioned granular detergent in tap water (or city water) at a temperature of 60° C. for 15 minutes. The sample fabrics were then rinsed with tap water at a temperature of 60° C. three times for 3 minutes each. The sample fabrics thus pre-treated were then placed into a jet type domestic electric washing machine and washed in a wash liquid containing the above-mentioned granular detergent and each additive composition listed in Table 1 in tap water for 10 minutes under the conditions of a liquid temperature of 25° C., a detergent concentration of 0.13%, and a bath ratio (i.e., a ratio of the washing liquid volume to the fabrics volume) of 30, followed by dewatering for 1 minute. Then, the washed sample fabrics were rinsed with tap water at a temperature of 25° C. for 3 minutes, followed by dewatering for 1 minute. This operation was repeated once more. Thereafter, the sample fabrics were air dried for 24 hours and, then, the air dried sample fabrics were conditioned under the conditions of a temperature of 25° C. and a relative humidity (RH) of 65%.

The nylon tricot cloths were sampled from the sample fabrics obtained above and fabric-softening effects of the additive compositions listed in Table 1 were evaluated by a sensory test using a panel consisting of 5 members (tactile impression). The results were scored on average as follows. The tactile impression of the same nylon tricot cloths treated in the same manner as mentioned above, except that no additive composition was used, was standardized as zero (0).

| Impression | Score |
|---|---|
| Excellently soft | 5 |
| Very soft | 4 |
| Soft | 3 |
| Fairly soft | 2 |
| Slightly soft | 1 |

The test results are shown in Table 1.

(2) Particle deposition test

The amount of the deposition of the additive composition particles on the washed fabrics was evaluated by washing the following sample fabrics with the above-mentioned mixture of granular detergent and additive compositions.

| | |
|---|---|
| Black nylon slip | 80 g × 2 pieces |
| Black acrylic sweater | 180 g × 2 pieces |
| Blue cotton knitted shirt | 100 g × 5 pieces |

The soiled sample fabrics were placed in a jet type domestic electric washing machine and were washed by using the above-mentioned granular detergent, the additive compositions, and tap water at a temperature of 5° C. under the conditions of a detergent concentration of 0.26% and a bath ratio of 30 for 5 minutes. Then, the washed sample fabrics were rinsed with tap water at a temperature of 5° C. twice each for 3 minutes, followed by dewatering. The amounts of the particles deposited on the washed fabrics were visually evaluated under the following evaluation standards:

| | |
|---|---|
| No particle deposition | ++ |
| No appreciable particle deposition | + |
| Somewhat particle deposition | ± |
| Remarkable particle deposition | − |

The test results are shown in Table 1.

TABLE 1

| Example No. | Nonionic surfactant Type | Ratio | Compounding amount (%) | Particle deposition | Softening effect |
|---|---|---|---|---|---|
| 1*5 | — | — | — | ++ | 0 |
| 2*5 | — | — | 5 | — | 3 |
| 3 | Nonylphenol ethoxylate ($\overline{EOP}$ = 5) | 75/25 | 5 | + | 4 |
| 4 | Nonylphenol ethoxylate ($\overline{EOP}$ = 8) | 75/25 | 5 | ++ | 3 |
| 5 | Nonylphenol ethoxylate ($\overline{EOP}$ = 8) | 90/10 | 5 | + | 3 |
| 6 | Dobanol 25 ethoxylate*3 ($\overline{EOP}$ = 6) | 75/25 | 5 | + | 3 |
| 7 | Diadol 911 ethoxylate*4 ($\overline{EOP}$ = 5) | 75/25 | 5 | + | 3 |
| 8 | Diadol 911 ethoxylate*4 ($\overline{EOP}$ = 10) | 75/25 | 5 | ++ | 3 |
| 9 | Sucrose monooleate | 75/25 | 5 | + | 3 |
| 10 | Sorbitan monooleate | 75/25 | 5 | + | 3 |
| 11 | Sorbitan dioleate | 75/25 | 5 | + | 3 |

*1Weight ratio of quaternary ammonium salt/nonionic surfactant
*2Amount of additive composition in terms of quarternary ammonium salt based on granular detergent
*3Dobanol 25: Primary alcohol having 12 to 15 carbon atoms available from Mitsubishi Petrochemical Company, Ltd.
*4Diadol 911: Primary alcohol having 9 to 11 carbon atoms available from Mitsubishi Chemical Industries Ltd.
*5Comparative example (no additive composition was used in example 1 and an additive composition not containing nonionic surfactant was used in example 2)

We claim:

1. An additive composition for a granular detergent comprising:

(a) a quaternary ammonium salt having the general formula (I):

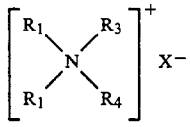

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 5 mole oxyalkylene units, and X represents a halogen atom, $CH_3SO_4$, $C_2H_5SO_4$, or

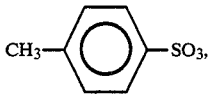

and (b) at least one nonionic surfactant selected from the group consisting of alkyl- or alkenyl-ethoxylates having an alkyl or alkenyl with 9 to 11 carbon atoms and having an average ethylene oxide addition mole number of 5 to 12, alkyl- or alkenylphenylethoxylates having an alkyl or alkenyl with 6 to 13 carbon atoms and having an average ethylene oxide addition mole number of 3 to 8, sucrose mono- or di-fatty acid esters, and sorbitan mono- or di-fatty acid esters, the ratio of component (a)/- component (b) in a weight basis of 99.5/0.5 to 50/50, and said additive composition being granulated from a mixture of the molten quaternary ammonium salt having the general formula (I) and the nonionic surfactant by (i) spraying the mixture, followed by cooling or (ii) solidifying the mixture upon cooling, followed by crushing.

2. An additive composition as claimed in claim 1, wherein the quaternary ammonium salt is at least one member selected from the group consisting of dihydrogenated tallow alkyl dimethyl ammonium chloride, distearyl dimethyl ammonium chloride, and dihydrogenated tallow alkyl benzyl methyl chloride.

3. An additive composition as claimed in claim 1, wherein the nonionic surfactant is at least one member selected from the group consisting of nonylphenol exthoxylates having an average ethylene oxide addition mole number of 3 to 8, sucrose monooleate, sorbitan monooleate, sorbitan dioleate, and alkylethoxylates having an alkyl group with 9 to 11 carbon atoms and having an average ethylene oxide addition mole number of 7 to 9.

4. An additive composition as claimed in claim 1, wherein the weight ratio of component (a)/component (b) is 99/1 to 75/25.

* * * * *